United States Patent [19]

Barber

[11] Patent Number: 4,737,341

[45] Date of Patent: Apr. 12, 1988

[54] TITANIUM-BASE ALLOYS

[75] Inventor: Anthony C. Barber, Sutton, England

[73] Assignee: IMI Titanium Limited, Wilton, United Kingdom

[21] Appl. No.: 38,353

[22] Filed: Apr. 14, 1987

[30] Foreign Application Priority Data

Apr. 18, 1986 [GB] United Kingdom ..... 8609580

[51] Int. Cl.[4] ..... C22C 14/00

[52] U.S. Cl. ..... 420/419; 420/418

[58] Field of Search ..... 420/418, 419, 421; 148/12.7 B, 407, 421

[56] References Cited

U.S. PATENT DOCUMENTS 3,540,946 11/1970 Minton et al. ..... 420/418

FOREIGN PATENT DOCUMENTS 596202 4/1960 Canada ..... 420/418

1403206 8/1975 United Kingdom .

*Primary Examiner*—L. Dewayne Rutledge

*Assistant Examiner*—Robert L. McDowell

*Attorney, Agent, or Firm*—Cushman, Darby & Cushman

[57] ABSTRACT

Creep resistant titanium alloys containing aluminum, zirconium, molybdenum and germanium plus optional silicon, carbon, tin and niobium.

9 Claims, No Drawings

TITANIUM-BASE ALLOYS

BACKGROUND OF THE INVENTION

This invention relates to titanium base alloys. All percentages are weight percentages.

SUMMARY OF THE INVENTION

According to the present invention we provide a titanium base alloy consisting of 5.0–7.0% aluminium, 2.0–7.0% zirconium, 0.1–2.5% molybdenum and 0.01–10.0 germanium and optionally one or more of the following elements: tin 2.0–6.0%, niobium 0.1–2.0%, carbon 0.02–0.1% and silicon 0.1–2.0%; the balance being titanium apart from incidental impurities.

The aluminium content may be in the range 5.0–6.0% or 5.0–6.5%.

The zirconium content may be in the range 2.0–4.0%, 2.0–6.0% or 3.0–7.0%.

The molybdenum content may be in the range 0.1–0.6%, 0.25–0.75% or 2.0–2.5%.

The germanium content may be in the range 0.01–5.0%, 0.01–0.2%, 0.01–0.5%, 0.1–2.0% or 2.0–5.0%.

More particularly, the alloy may consist of 5.3–6.1% aluminium, 3.5–4.5% tin, 3.0–4.0% zirconium, 0.5–1.0% niobium, 0.2–0.7% molybdenum, 0.1–0.5% silicon, 0.03–0.10% carbon and 0.3–3.0% germanium, the balance being titanium apart from incidental impurities.

Alternatively, the alloy may consist of 5.3–6.1% aluminium, 3.5–4.5% tin, 3.0–4.0% zirconium, 0.5–1.0% niobium, 0.2–0.7% molybdenum, 0.03–0.10% carbon and 0.3–3.0% germanium, the balance being titanium apart from incidental impurities.

Alternatively, the alloy may consist of 5.6–6.0% aluminium, 3.5–4.5% tin, 3.0–4.0% zirconium, 0.6–0.8% niobium, 0.3–0.6% molybdenum, 0.03–0.10% carbon, 0.15–0.5% silicon and 0.5–2.5% germanium, the balance being titanium apart from incidental impurities.

Alternatively, the alloy may consist of 5.6–6.0% aluminium, 3.5–4.5% tin, 3.0–4.0% zirconium, 0.6–0.8% niobium, 0.3–0.6% molybdenum, 0.03–0.10% carbon and 1.0–3.0% germanium, the balance being titanium apart from incidental impurities.

The alloys according to the invention are preferably heat-treated and subsequently cooled. The alloys are then preferably aged by heating to a selected temperature for a predetermined period of time and then cooled. The aging temperature may be in excess of 600° C. and may be as high as 700° C.

DESCRIPTION OF THE PREFERRED EMBODIMENT

Examples of an alloy according to the invention are now provided.

The alloys set out in Table 1 below were prepared:

TABLE 1

| ALLOY | Analysed Compositions (wt %) Al | Sn | Zr | Nb | Mo | C | Si | Ge |
|---|---|---|---|---|---|---|---|---|
| No. 1 | 5.78 | 4.0 | 3.5 | 0.7 | 0.48 | 0.08 | 0.2 | 1.1 |
| No. 2 | 5.79 | 4.0 | 3.5 | 0.7 | 0.49 | 0.08 | 0.2 | 0.6 |
| No. 3 | 5.88 | 4.0 | 3.5 | 0.7 | 0.48 | 0.07 | 0 | 2.0 |

The prepared alloys were then each heat treated at 1030° C. for 2 hours and then air cooled. Subsequently each alloy was aged by heating at 700° C. for 2 hours. The mechanical properties for each alloy are set out in Table 2 below. The creep exposure was 100 hours at 600° C. at 125 MPa for each sample.

TABLE 2

| ALLOY | Test | Mechanical Properties for 700° C. Age TPS $Nmm^{-2}$ | 0.1% YS $Nmm^{-2}$ | 0.2% YS $Nmm^{-2}$ | UTS $Nmm^{-2}$ | Elongation % | Red. Area % |
|---|---|---|---|---|---|---|---|
| No 1 | A | | 990 | 1030 | 1164 | 10 | 18 |
| | B | | 286 | 342 | 551 | 66 | 86 |
| | C | 0.102 | 1044 | 1059 | 1041 | 1 | 2 |
| No 2 | A | | 972 | 1002 | 1125 | 9 | 15 |
| | B | | 329 | 355 | 532 | 40 | 71 |
| | C | 0.124 | 1022 | 1038 | 1125 | 1½ | 3 |
| No 3 | A | | 1033 | 1069 | 1196 | 8 | 16 |
| | B | | 373 | 414 | 583 | 55 | 71 |
| | C | 0.104 | 1093 | 1107 | 1111 | 1 | ½ |

TPS = Total Plastic Strain
YS = Yield Stress

Test A was at room temperature; Test B was at an elevated temperature of 700° C.; Test C was at room temperature after the creep exposure referred to above.

The increase in yield stress for these alloys aged at 700° C. shows significant improvements over a comparable alloy containing silicon but with no germanium.

The alloys in accordance with the invention possess excellent creep resistance particularly at temperatures above 540° C. which makes them particularly valuable in gas turbine engine applications.

I claim:

1. A titanium base alloy consisting of 5.0–7.0% aluminium, 2.0–7.0% zirconium, 0.1–2.5% molybdenum and 0.01–10.0 germanium and optionally one or more of the following elements: tin 2.0–6.0%, niobium 0.1–2.0%, carbon 0.02–0.1% and silicon 0.1–2.0%; the balance being titanium apart from incidental impurities.

2. A titanium base alloy as claimed in claim 1 in which the aluminium content is in the range 5.0–6.0% or 5.0–6.5%.

3. A titanium base alloy as claimed in claim 1 or claim 2 in which the zirconium content is in the range 2.0–4.0%, 2.0–6.0% or 3.0–7.0%.

4. A titanium base alloy as claimed in claim 1 in which the molybdenum content is in the range 0.1–0.6%, 0.25–0.75% or 2.0–2.5%.

5. A titanium base alloy as claimed in claim 1 in which the germanium content is in the range 0.01–5.0%, 0.01–0.2%, 0.01–0.5%, 0.1–2.0% or 2.0–5.0%.

6. A titanium base alloy as claimed in claim 1 in which the alloy consists of 5.3–6.1% aluminium, 3.5–4.5% tin, 3.0–4.0% zirconium, 0.5–1.0% niobium, 0.2–0.7% molybdenum, 0.1–0.5% silicon, 0.03–0.10% carbon and 0.3–3.0% germanium, the balance being titanium apart from incidental impurities.

7. A titanium base alloy as claimed in claim 1 in which the alloy consists of 5.3–6.1% aluminium, 3.5–4.5% tin, 3.0–4.0% zirconium, 0.5–1.0% niobium, 0.2–0.7% molybdenum, 0.03–0.10% carbon and 0.3–3.0% germanium, the balance being titanium apart from incidental impurities.

8. A titanium base alloy as claimed in claim 1 in which the alloy consists of 5.6–6.0% aluminium, 3.5–4.5% tin, 3.0–4.0% zirconium, 0.6–0.8% niobium, 0.3–0.6% molybdenum, 0.03–0.10% carbon, 0.15–0.5% silicon and 0.5–2.5% germanium, the balance being titanium apart from incidental impurities.

9. A titanium base alloy as claimed in claim 1 in which the alloy consists of 5.6–6.0% aluminium, 3.5–4.5% tin, 3.0–4.0% zirconium, 0.6–0.8% niobium, 0.3–0.6% molybdenum, 0.03–0.10% carbon and 1.0–3.0% germanium, the balance being titanium apart from incidental impurities.

* * * * *